United States Patent [19]

Growall

[11] Patent Number: 4,955,618

[45] Date of Patent: Sep. 11, 1990

[54] MOUNTAINEERING STRATEGY BOARD GAME

[76] Inventor: Joseph R. Growall, 518 W. Columbia St., Colorado Springs, Colo. 80907

[21] Appl. No.: 368,423

[22] Filed: Jun. 19, 1989

[51] Int. Cl.[5] ..... A63F 3/00

[52] U.S. Cl. ..... 273/258; 273/244; 273/249; 273/259

[58] Field of Search ..... 272/243, 244, 251, 265, 272/258, 242, 138 R, 142 C, 249, 259, 142 J, 281, 283, 289, 271, 298, 305

[56] References Cited

U.S. PATENT DOCUMENTS

| | | | |
|---|---|---|---|
| 2,729,451 | 1/1956 | Larson | 273/251 |
| 3,046,017 | 7/1962 | Kazakevich | 273/265 |
| 3,706,456 | 12/1972 | Sesti et al. | 273/138 R |
| 3,792,865 | 2/1974 | Credico, Jr. et al. | 273/283 |
| 4,147,358 | 4/1979 | Erickson | 273/283 |
| 4,502,689 | 3/1985 | Al-Harasi | 273/265 |

*Primary Examiner*—Edward M. Coven
*Assistant Examiner*—William E. Stoll

[57] ABSTRACT

An apparatus and method for playing a board game is provided, to which the theme of mountaineering is most preferably applied. The game utilizes a standard grid as a playing field which is designed to simulate the map of a mountain. Indicia such as numbers or letters are assigned to the columns and rows of the grid so that each grid space may be identified through the use of coordinates. The grid is also divided into several sections, each of which will serve as the designated area through which an individual player will maneuver playing tokens along an established route of movement and alternates thereof. An adjustable indicator, the control of which is vied for by opponents through play action, establishes limits on the number of spaces playing tokens may advance in each of the aforementioned sections of the grid during any given turn. A deck of playing cards, which correlates to the indicia assigned to the columns and rows of the grid, provides the medium through which players act to advance their own playing tokens as they impose setbacks upon the tokens of their opponents in an effort to be the first to reach a summit finish location to win the game.

10 Claims, 3 Drawing Sheets

MOUNTAINEERING STRATEGY BOARD GAME

SUMMARY

It is an object of the present invention to provide a board game, to which the theme of mountaineering is most preferably applied, for the purpose of entertaining and educating those intrigued by the challenge of mountaineering, and those intrigued by the prospect of outwitting opponents in a game of strategy.

The board game apparatus needed to execute this method for playing a board game consists of a game board, a quantity of first playing tokens, a quantity of second playing tokens, and a deck of playing cards. The general nature and purpose of each of the aforementioned elements of the game board apparatus will be discussed briefly, followed by a more specific presentation of the inventor's preferred embodiment.

The game board itself bears upon its upper surface a multiplicity of spaces arranged in a grid fashion of columns and rows. Indicia, such as numbers or letters, are assigned to each column and row of the grid so that each grid space may be identified through the use of coordinates.

The grid is also divided into several sections, each of which is labeled so that it may be distinguished from the other sections of the grid. Each section defines an area of the grid through which an individual player will maneuver playing tokens during the course of play. The rows of grid spaces within each section can be differentiated by numbers assigned thereto, yet each section row remains a part of that greater column or row which spans the breadth of the grid.

The game board also provides a start and finish location for each of the aforementioned sections of the grid. These start and finish locations coincide with spaces on the grid so that each may be identified through the use of coordinates. From each start location to the corresponding finish location a route of movement, and alternates thereof, is provided. These routes of movement and their alternates are designed so, that when playing tokens are advanced along them, the playing tokens will always occupy a space on the grid which can be identified through the use of coordinates.

The game board also provides an indicator which will constantly regulate the number of spaces a player may advance his playing tokens within each section of the grid. Players gain control of this regulating indicator by occupying specially designated grid spaces with their playing tokens, and by skillfully playing out those playing cards which are dealt to them.

This brings us to the playing cards themselves. For each column in the grid there are several playing cards bearing the coordinate indicia of that column. Similarly, for each row in the grid there are several playing cards bearing the coordinate indicia of that row, and finally, each card in the deck will bear the label of one of the grid's sections.

At the beginning of the game players are dealt a quantity of cards which are replaced by cards from the deck as they are used. Players use the cards in their possession to create key card combinations which will impose setbacks upon the playing tokens of their opponents, and fuel the advance of their own playing tokens.

A single first playing token is provided for each player which will represent the player's position as he advances along his route of movement. Each player will also have a second playing token which will be used to support the advance of his first playing token. More specifically, as a player advances his first playing token along his route of movement his second playing token will be periodically advanced to mark the space to which his first playing token may have to return as the result of a setback imposed by an opponent. No attempt will be made here to define the physical form of the playing tokens other than to say that the first playing token of each player will differ in appearance from that of his second playing token, and that each player's set of playing tokens will be distinguishable from those sets of the other players. Of course, the best designs contemplated by the inventor for all components of the game board apparatus are clearly set forth in the drawings appended to this disclosure.

Other objects and features of the present invention will become apparent from the following detailed description of the preferred embodiment when taken in connection with the appended drawings. It is to be understood that these drawings are designed for the purpose of reference and illustration only. They disclose one embodiment of the present invention and are not intended to be a definition of its limits and scope.

BRIEF DESCRIPTION OF DRAWINGS

The description herein makes reference to the accompanying drawings wherein like reference letters refer to similar elements throughout the several figures, and wherein.

DETAILED DESCRIPTION OF THE PREFERRED EMBODIMENT

Figure 1:
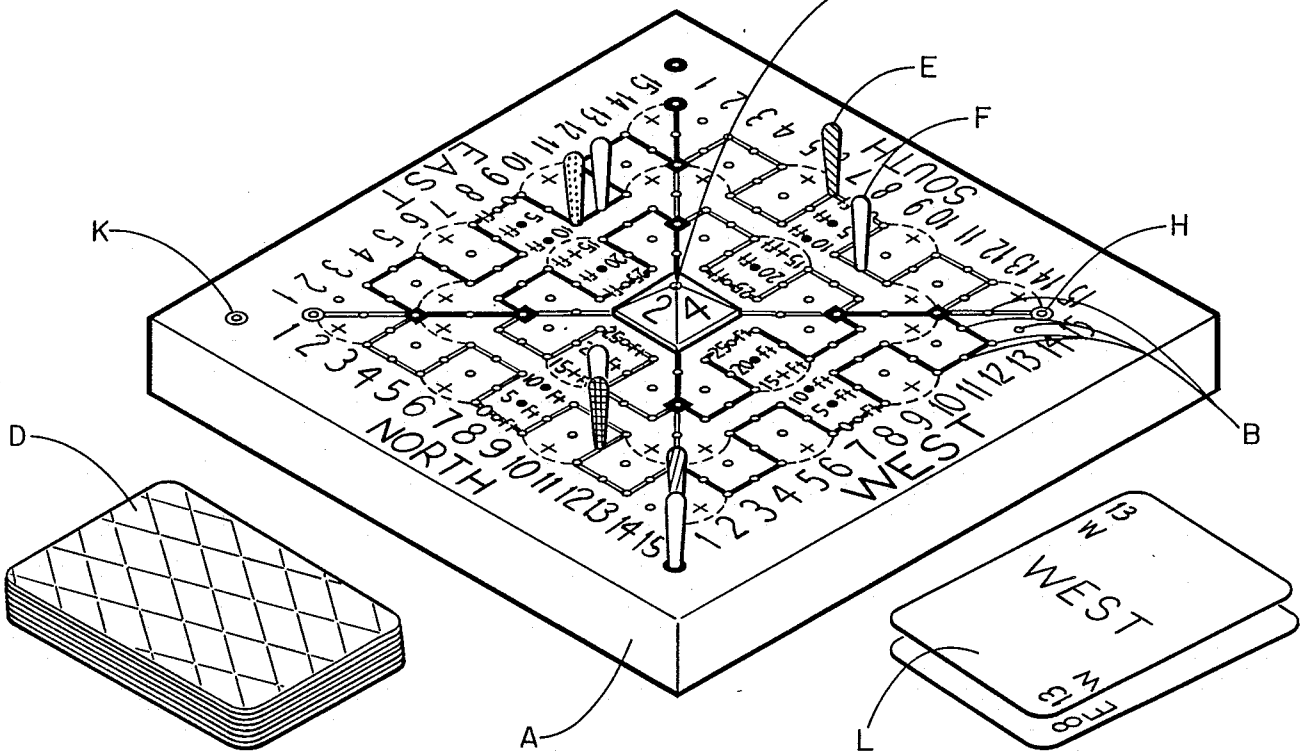
FIG. 1 is a perspective drawing of the preferred embodiment of the present invention.

Referring now to the appended drawings, therein illustrated is a novel game board apparatus embodying the present invention which, as shown in FIG. 1, includes a game board (A) which is essentially a pegboard with pegholes or spaces (B) arranged on its upper surface in a 15×15 space grid pattern consisting of 15 columns number "1 through 15" and 15 rows, also number "1 through 15". The grid is also divided into four triangular shaped sections which represent the four faces of a mountain and are accordingly labeled North, East, South and West.

Mounted at grid center is a pyramidal extraplanar rotating device (C) the four sides of which are numbered "2, 4, 4, and 6" respectively. This device, hereinafter referred to as "the Summit" (C), serves as an indicator which regulates playing token movement in each of the four sections of the grid. Its presence will negate the use of the nine innermost spaces of the grid. The numbers on each side of the Summit (C) will specify the maximum number of spaces playing tokens may be moved in the grid sections corresponding to those numbers, and since the Summit (C) is subject to rotation, the grid section to which a number corresponds will change throughout the course of the game.

Also included is a deck (D) of 60 playing cards which consists of four sets of 15 cards numbered "1 through 15", each set labeled North, East, South or West. These cards correlate to and are used in conjunction with the grid coordinate numbers applied to the game board (A) at the periphery of the grid. The numbers of any two cards in the deck (D) will combine to form the coordinates of one of the spaces (B) on the grid, and in most instances the same pair of cards will represent more than one grid space (B). It is, therefore, sometimes necessary for players to specify the exact grid space (B) they intend such a pair of cards to represent. In most cases, however, the game situation will make the player's intentions obvious.

In further reference to the cards and their relation to the grid coordinate system, the grid section with which a card is labeled (North, East, South or West) will have no bearing on how that card is paired with another to form the coordinates of a grid space (B). Conversely, the grid section in which a space (B) is located will have no bearing on which playing cards may be paired to form the coordinates of that space (B).

Figure 3:
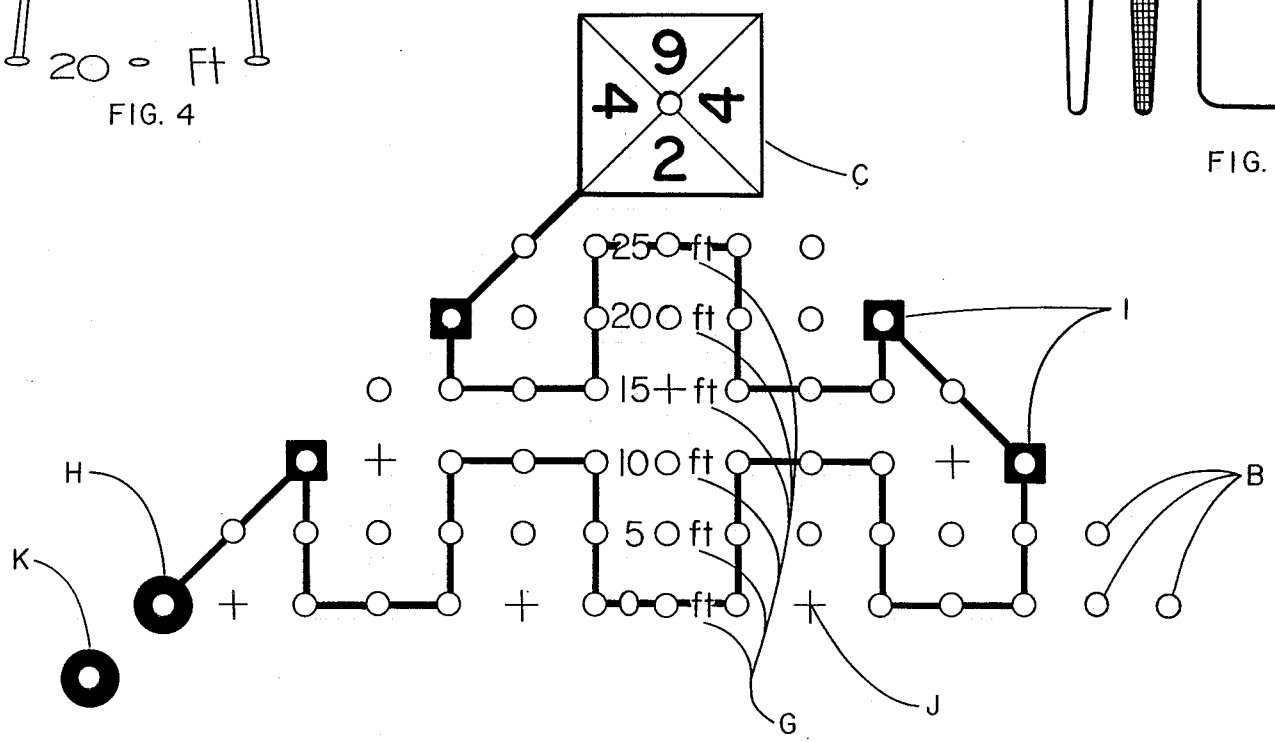
FIG. 3 depicts the general pattern common to each route of movement on the game board presented in FIG. 1 and FIG. 2.
Figure 4:
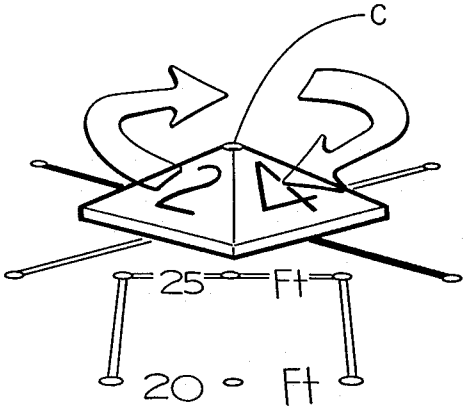
FIG. 4 is an action drawing which shows how the centrally located pyramidal device known as the Summit may be rotated.

The game board apparatus also includes four colored pegs (E) which will mark the position of players as they advance along their respective routes of movement (FIG. 3). To accompany each colored peg (E) a white peg (F) is provided which will mark the space (B) to which a player's colored peg (E) may have to return as the result of a setback imposed by an opponent. These white pegs (F) are advanced periodically as a "back-up" in order to secure those advances made with the colored peg (E).

Figure 2:
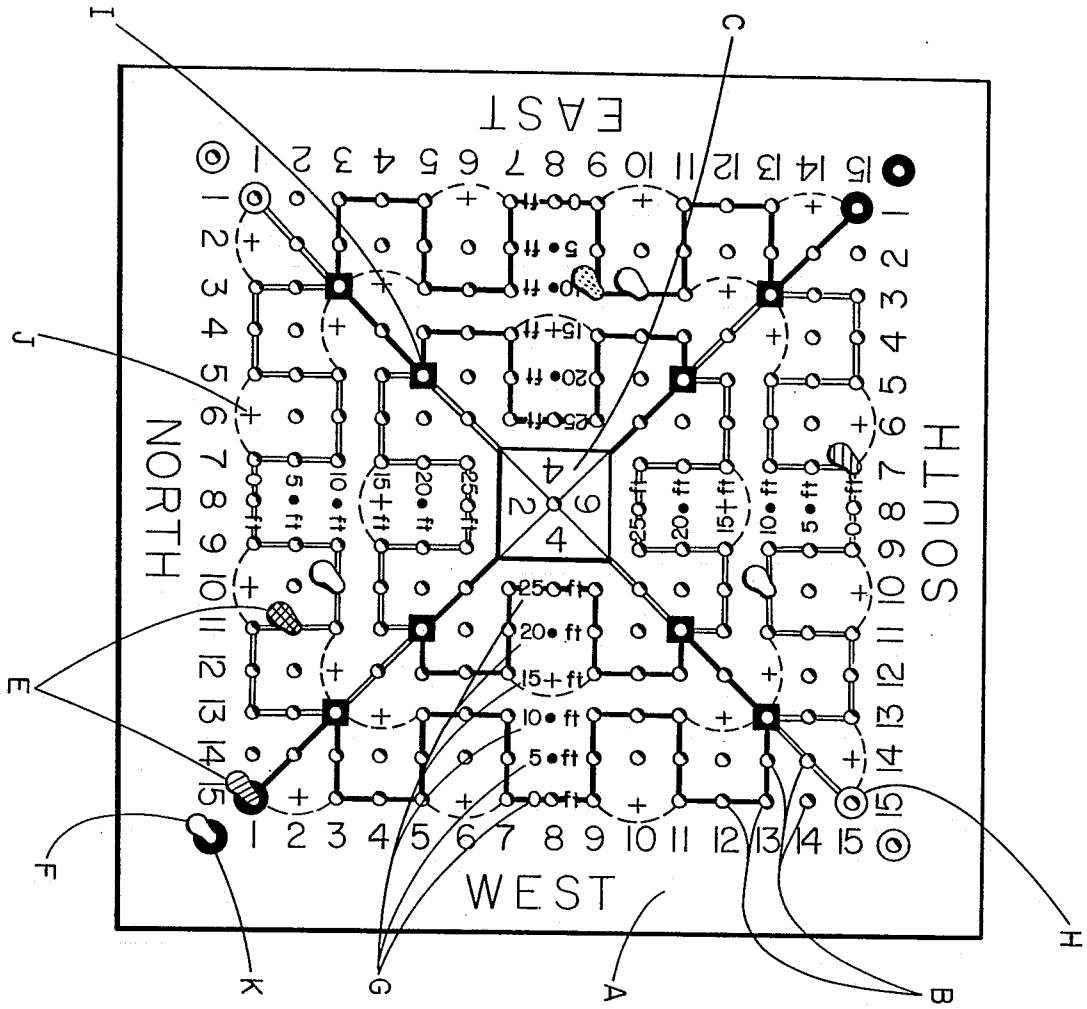
FIG. 2 is a top view of the game board presented in FIG. 1.
Figure 5:
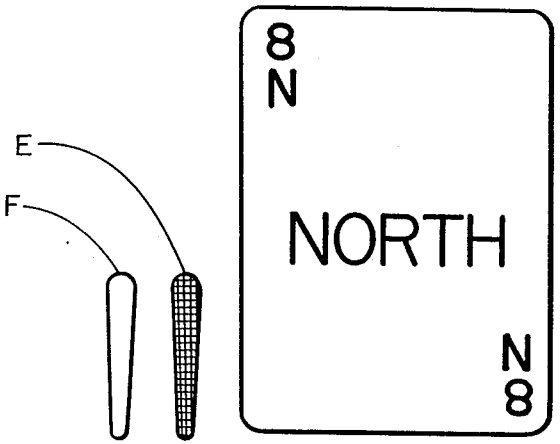
FIG. 5 is a drawing of the type of playing card and tokens which are used to play the game.

Referring now to FIG. 2, which provides a more accommodating view of the playing field and the graphics applied to the game board (A), we see that the rows of spaces within each triangular section of the grid are labeled "0 ft. through 25 ft." using a multiple of five feet for each section row, said section rows being those which run parallel to the side of the game board (A) corresponding to that particular section. These labels represent the Elevation (G) of each section row in thousands of feet.

The four corner spaces on the grid serve as Start Locations (H). A color-coded line extends from each Start Location (H) passing through numerous spaces (B) of the corresponding grid section following the general pattern depicted in FIG. 3. Each color-coded line is a player's route of movement (FIG. 3) and the spaces on it are the only spaces on the grid which his playing tokens may legitimately occupy as they are advanced from his Start Location (H) to the space atop the Summit (C), which serves as a common finish location to all players. In the case of the appended drawings, color-coding for each player's route of movement (FIG. 3) will alternate between black and white as one circles the game board (A).

Each route of movement (FIG. 3) will intersect another at four different points on the grid forming a total of 16 points of intersection, each marked by a black square known as a Refuge Hut (I).

The curved dotted lines which circumnavigate X-shaped grid spaces, called Crevasses (J), serve as alternate pathways or "short-cuts" which players may use under certain conditions to decrease the distance they must travel from their Start Location (H) to the Summit (C).

Turning now to the playing of the game, the objective is to be the first player to advance his/her colored peg (E) from her/his Start Location (H) along the route of movement (FIG. 3) to the space atop the Summit (C) positioned at grid center. The first player to occupy the Summit (C) with his/her colored peg (E) wins the game.

To start, each player will select a section of the grid (North, East, South or West) and position the appropriate colored peg (E) in the Start Location (H) provided for that section. Players will also position a white peg (F) in the holding space (K) provided for it next to their Start Location (H).

After shuffling the deck (D), six cards will be dealt face down to each player. The remainder of the deck (D) will be placed face down beside the board (A). The top card will then be taken from the deck (D) and placed face up beside an opposing side of the board (A) to start a discard pile (L). The Summit (C), positioned at grid center, must now be rotated so that the lowest number—the number "2"—is facing that grid section represented by the face-up card which started the discard pile (L). The player occupying that section of the grid overlooked by the number "2" shall have the first turn. Should there be no player occupying that grid section, as may be the case with fewer than four players, move clockwise to the next available player. Order of play will rotate in a clockwise direction.

Each player will begin his turn by selecting the top card from either the deck (D) or the desired pile (L) and placing that card in his hand along with the other cards which were dealt to him earlier. Then, using the cards in his hand, the player must try to form one of six possible card combinations—all six of which will soon be described in great detail.

In forming these card combinations, players will be able to advance their own pegs, and impose setbacks upon the pegs of their opponents, in accordance with the directions given for each card combination. Each player will form only one card combination per turn as play passes from one player to the next. Card combinations are played by placing them face up on the discard pile (L).

Following the play of a card combination, or after determining that a combination cannot be made, the player will end his turn by discarding one of the cards remaining in his hand, placing it face up on the discard pile (L). Thus, the board (A) is made ready for the next player who will choose the top card from either the deck (D) or the discard pile (L) to begin his turn.

SUMMIT CONTROL

First Man Out—As players create card combinations to advance their pegs, the number of cards in each player's hand will slowly diminish until one player is forced to discard the last card in his hand. When this happens, the Summit (C) will be rotated so that the number "2" faces that section of the grid represented by said last card. The player discarding said last card—the first man out—will then deal himself a new hand of six cards, and to each of his opponents he will deal the number of cards necessary for everyone to again have a full hand of six cards. Opponents will retain the cards they were holding, when the "dealer" discarded out, as part of their new hand. A new round will begin with the player whose grid section is overlooked by the number "2" having the first turn, and so it will continue until one player wins the game. Discards can be reshuffled to form a new deck (D), but the top discard must remain as a place-holder for the discard pile (L) when other discards are reshuffled.

Refuge Huts—Whenever a player uses a turn to advance either his colored peg (E) or his white peg (F) so that it occupies one of the black squares known as a Refuge Hut (I), the Summit (C) will be rotated so that the number "2" faces that section of the grid represented by the card said player discards to end that turn. Pegs which come to occupy a Refuge Hut (I) as the result of a setback imposed by an opponent will not initiate a Summit (C) rotation. Furthermore, any card combination which would force a peg back to an occupied Refuge Hut (I) cannot be played. Likewise, no peg may be advanced to an occupied Refuge Hut (I).

As previously mentioned it will be necessary for players to form various card combinations in order to advance their playing tokens along their respective routes of movement (FIG. 3), and impose setbacks upon the playing tokens of their opponents. Of course, there are an infinite variety of card combinations which could be devised to accomplish this task, but any such card combination—other than those about to be described—would constitute nothing more than a variation on the method of play presently being disclosed. Moreover, such variations would not constitute a significant departure from the spirit or scope of the present invention, nor could such variations be deemed useful in the absence of a game board apparatus such as the one previously described in this disclosure.

Listed below are six of the best card combinations contemplated by the inventor. Included with each is a description of the cards which comprise the combination, and the playing token manipulations each combination will induce. The playing token manipulations initiated by these card combinations are intended to simulate occurrences which might be experienced by two-main climbing teams attempting to climb a mountain. Let it be understood that in these following six descriptions the term "player" will refer to that individual who is forming the card combination, while the term "opponent" will refer to other participants in the game.

CARD COMBINATIONS

1. Any two cards, regardless of grid section label, which will form the coordinates of a grid space (B) occupied by an opponent's colored peg (E) will force said colored peg (E) to be set back along the opponent's route of movement (FIG. 3) to the space (B) on said route which is immediately in front of the opponent's white peg (F), the phrase "in front of" herein understood to mean—that position on a route of movement (FIG. 3) which is toward the Summit (C) relative to an arbitrary fixed point of reference also located on said route.

Meanwhile, the player forming such a card combination will be allowed to advance his colored peg (E) along his route of movement (FIG. 3) any number of spaces not to exceed the number on the Summit (C) facing said player's grid section.

This card combination will not be used against an opponent whose colored peg (E) already occupies the space (B) immediately in front of his white peg (F).

2. Any six cards with the same grid section label will force the white peg (F) of the opponent in that section to be set back along the opponent's route of movement (FIG. 3) a number of spaces equal to the number on the Summit (C) facing the opponent's grid section, or back to the opponent's holding space (K)—whichever distance amounts to the fewer number of spaces. After which said opponent's colored peg (E) will also be set back to the space (B) on his route of movement (FIG. 3) which is immediately in front of his white peg's new position.

Meanwhile, the player forming such a card combination will be allowed to advance his colored peg (E) along his route of movement (FIG. 3) any number of spaces not to exceed the number on the Summit (C) facing his grid section. After which said player may also advance his white peg (F) to the space (B) immediately behind his colored peg's new position, the term "behind" herein understood to mean—that position on a route of movement (FIG. 3) which is toward the Start Location (H) relative to an arbitrary fixed point of reference also located on said route.

This card combination may be played whether the grid section represented by the cards is occupied or not, and regardless of whether the opponent's playing tokens are actually set back or not, as may be the case toward the beginning of the game.

3. Any two cards, regardless of grid section label, which can be added together or subtracted, one from the other, to equal the Elevation (G) of the section row upon which the player's colored peg (E) is situated will permit the player to advance his colored peg (E) along his route of movement (FIG. 3) any number of spaces not to exceed the number on the Summit (C) facing the player's grid section. No setbacks will result from the formation of this card combination.

4. Any two cards, regardless of grid section label, which will form the coordinates of an X-shaped grid space known as a Crevasse (J) will permit the player to advance his colored peg (E) along the curved dotted line circumnavigating that Crevasse (J)—from one end to the other—provided the player's colored peg (E) occupied an endpoint of said curved dotted line when his turn began. No setbacks will result from the formation of this card combination.

5. Any two cards, regardless of grid section label, which will form the coordinates of a space (B) on the player's route of movement (FIG. 3) which lies between his colored peg (E) and his white peg (F) will allow the player to advance his white peg (F) to the space (B) represented by said cards. No setbacks will result from the formation of this card combination.

6. Any two cards, regardless of grid section label, which will form the coordinates of a space (B) on an opponent's route of movement (FIG. 3) which lies between the opponent's colored peg (E) and his white peg (F) will force the opponent's white peg (F) to be set back along said opponent's route a number of spaces equal to the number on the Summit (C) facing the opponent's grid section.

Meanwhile, the player forming such a card combination will be allowed to advance his colored peg (E) along his route of movement (FIG. 3) any number of spaces not to exceed the number on the Summit (C) facing the player's grid section.

Thus, it can be seen that this game is essentially based on the formation of these card combinations which provide players with a medium through which they may manipulate the various elements of the game board apparatus in accordance with the method of play herein described.

The method of play and the game board apparatus presented in this disclosure constitute but one embodiment of the game for which Letters Patent is sought, and while many variations may be arrived at through modification it is only by the breadth and scope of the appended claims that this invention will be limited.

What I claim is:

1. A board game apparatus comprising:

a. a game board which bears upon the face thereof, a multiplicity of spaces arranged in a grid pattern with indicia assigned to each column and row of the grid to form a coordinate system, boundary lines which divide said grid into labeled sections, each labeled section containing various segments of said columns and rows of grid spaces, said segments comprising section rows of grid spaces which are numbered so that the section rows within each section may be distinguished from one another, a route of movement and alternates thereof for each player to follow from spaces on the grid designated as start locations to a space on the grid designated as a finish location, wherein said route of movement and alternates thereof incorporate spaces which are located on the grid and which can be identified using said coordinate system, and a pyramidal extraplanar rotating device having the same number of sides adjoining its apex as the number of sections into which the grid has been divided, wherein each side of said device is numbered for regulating token movement in the section of the grid to which that particular side of said device corresponds, b. a deck of playing cards which correlates to said coordinate indicia and said section labels on said game board grid, c. a plurality of first playing tokens, each token representing a player's position as the player advances along said route of movement and alternates thereof, d. a plurality of second playing tokens, each second token marking the space on a player's route of movement to which said first playing token may return as the result of a setback imposed on said first playing token by an opponent.

2. The board game apparatus set forth in claim 1 wherein said coordinate indicia are whole numbers.

3. The method of playing a board game comprising a game board composed of sections wherein rows of spaces are numbered, a route of movement designated on said game board, a playing token to represent a player's position on said route of movement, a numbered set of playing cards, and a regulating device which determines the increment of playing token movement in each section of said game board, the method of play wherein players pair playing cards in their possession so that when the numerical value of one card in the pair is added to or subtracted from the numerical value of the other card in the pair, and the resulting sum or difference equals the number assigned to the section row of spaces upon which the player's token is situated, said player is permitted to move said token along a route of movement any number of spaces not to exceed the number specified by a regulating device which regulates token movement through each section of the game board.

4. The method of playing a board game comprising a game board composed of spaces arranged in a grid pattern with a number assigned to each column and row of said grid, a route of movement designated on said game board which incorporates a multiplicity of said grid spaces, an alternate pathway which serves as a direct link between two grid spaces otherwise separated by numerous spaces on said route of movement, a playing token to represent a player's position on said route of movement, a numbered set of playing cards, and a distinctively marked space on said grid which represents said alternate pathway, the method of play wherein players with a playing token occupying a space on the grid which is at the intersection of a route of movement and an alternate pathway may pair cards in their possession so that the numbers on the playing cards in the pair form the coordinates of a distinctively marked space on said grid which represents said alternate pathway, whereupon said token may be advanced along said alternate pathway to the space where said alternate pathway again intersects said route of movement.

5. The method of playing a board game comprising a game board composed of spaces arranged in a grid pattern with a number assigned to each column and row of said grid, a route of movement designated on said game board for each player in the game, said route incorporating a multiplicity of those spaces which form said game board grid, a first playing token for each player to mark their position on said route of movement, a second playing token for each player to mark the space on said route to which said first playing token may return as the result of a setback imposed by an opponent, and a numbered set of playing cards, the method of play wherein players pair cards in their possession so that the numbers on the playing cards in the pair form the coordinates of a space on their own route of movement which lies between their first and second playing tokens, whereupon the player forming said pair of playing cards is permitted to advance his second playing token to the grid space at the coordinates formed by said pair of playing cards.

6. The method of playing the board game of claim 5, wherein said game board is composed of separate and distinct sections, and a regulating device which determines the increment of playing token movement in each of said game board sections, the method of play wherein players pair playing cards in their possession so that the numbers on the playing cards in the pair form the coordinates of a space on the grid occupied by an opponent's first playing token, whereupon said first token is set back along the opponent's route of movement to the space immediately in front of said opponent's second playing token, after which the player forming said pair of playing cards is permitted to advance his first playing token along his route of movement any number of spaces not to exceed the number specified by a regulating device which regulates token movement through each of the game board sections.

7. The method of playing the game board of claim 6, the method of play wherein players pair playing cards in their possession so that the numbers on the playing cards in the pair form the coordinates of a space on an opponent's route of movement which lies between said opponent's first and second playing tokens, whereupon the second playing token of said opponent is set back along his route of movement the number of spaces specified by a regulating device which regulates token movement through each section of the game board, after which the player forming said pair of playing cards may advance his first playing token along his route of movement any number of spaces not to exceed the number specified by said regulating device.

8. The method of playing a board game comprising a game board composed of sections which are labeled so that each section may be distinguished from the other sections of said game board, a set of playing cards on the face of each of which appears the label of one of the sections of said game board, and a regulating device which determines the increment of playing token movement in each of said game board sections, the method of play wherein players purposely retain one of several playing cards dealt to them, as they play out the other cards in accordance with the rules of the game, so that when said retained card can be proffered as the sole card remaining in their possession a regulating device which regulates token movement through each section of the game board is adjusted so that the increment of playing token movement is shown to be lowest in that section of the game board represented by said proffered card.

9. The method of playing the board game of claim 8 further comprising a route of movement designated on said game board for each player, a first playing token for each player to mark their position on said route of movement, and a second playing token for each player to mark the space on said route to which said first token may return as the result of a setback imposed by an opponent, the method of play wherein players combine a predetermined number of cards in their possession so that all the cards in the combination bear the label of the same game board section, whereupon any opponent with a playing token positioned in the depicted section must set his second playing token back along his route of movement the number of spaces specified by a regulating device which regulates token movement through each section of the game board, after which said opponent must also set his first playing token back along his route to the space immediately in front of his second token's new position, whereupon the player forming said card combination is permitted to advance his first playing token along his route of movement any number of spaces not to exceed the number specified by said regulating device, after which said player may also advance his second playing token along his route to the space immediately behind his first token's new position.

10. The method of playing the board game of claim 8 further comprising a playing token for each player, and a specially designated space on said game board to accommodate said playing token, the method of play wherein players may change the increment of playing token movement in each section of a multi-section game board by occupying a specially designated space on said game board with a playing token designated as their own, whereupon the player occupying said specially designated space proffers to his opponents one of the playing cards in his possession, which causes a regulating device which regulates token movement through each section of said game board to be adjusted so that the increment of playing token movement is shown to be lowest in that section of said game board represented by said proffered card.

* * * * *